US005116290A

United States Patent [19]

Ross

[11] Patent Number: 5,116,290

[45] Date of Patent: May 26, 1992

[54] PACKAGING CONTAINER

[76] Inventor: John A. Ross, P.O. Box 201160, Durban North, South Africa, 4016

[21] Appl. No.: 622,979

[22] Filed: Dec. 6, 1990

[30] Foreign Application Priority Data

Feb. 20, 1990 [ZA] South Africa ..... 90/1258

[51] Int. Cl.[5] ..... B65D 5/32

[52] U.S. Cl. ..... 229/23 R; 229/109; 229/915; 229/DIG. 11; 206/509

[58] Field of Search ..... 229/23 R, DIG. 11, 915, 229/109, DIG. 15; 206/509; 220/4.28, 4.29

[56] References Cited

U.S. PATENT DOCUMENTS

| | | | |
|---|---|---|---|
| 3,915,372 | 10/1975 | Crane | 229/23 R |
| 3,935,990 | 2/1976 | Crane | 229/23 R |
| 3,935,991 | 2/1976 | Crane | 229/23 R |
| 4,211,358 | 7/1980 | Crane | 229/23 C |
| 4,277,015 | 7/1981 | Crane | 229/23 C |
| 4,482,074 | 11/1984 | Lalley | 229/23 R |
| 4,884,739 | 12/1989 | Nederveld | 206/509 |

FOREIGN PATENT DOCUMENTS

| | | | |
|---|---|---|---|
| 0804407 | 1/1969 | Canada | 229/109 |

*Primary Examiner*—Stephen Marcus
*Assistant Examiner*—Christopher J. McDonald
*Attorney, Agent, or Firm*—Selwyn S. Berg; Piet Burger

[57] ABSTRACT

This invention relates to a packaging container, and a preform therefor, which finds particular application in the packaging and protection of relatively soft products, such as fresh produce. The container comprises a pair of end web plates (12) formed with peripherally extending projections (20). A cover sheet (10) is wrapped about the peripheries of the web plates (12). The cover sheet (10) is folded along fold lines (16) and is formed with slots (18) through which the projections (20) on the web plates (12) may extend when the cover sheet (10) is wrapped about the web plates (12). The web plates (12) are formed with locking slots (26) into which the longitudinal edges (28) of the cover sheet (10) may be clipped to retain the cover sheet (10) in position.

8 Claims, 5 Drawing Sheets

Fig. 1
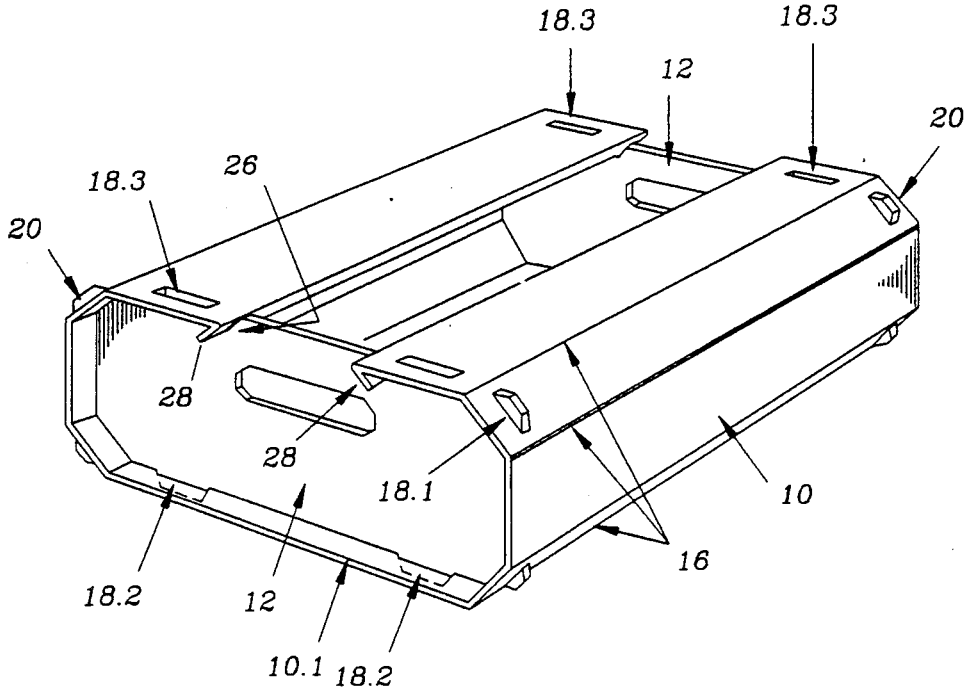
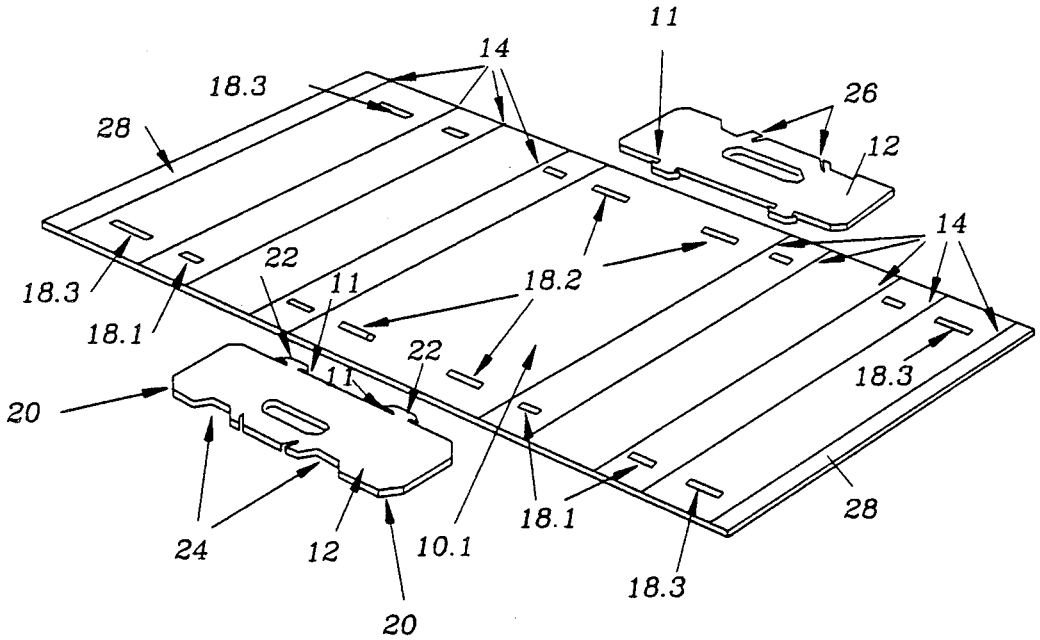
Fig. 2

Fig. 3
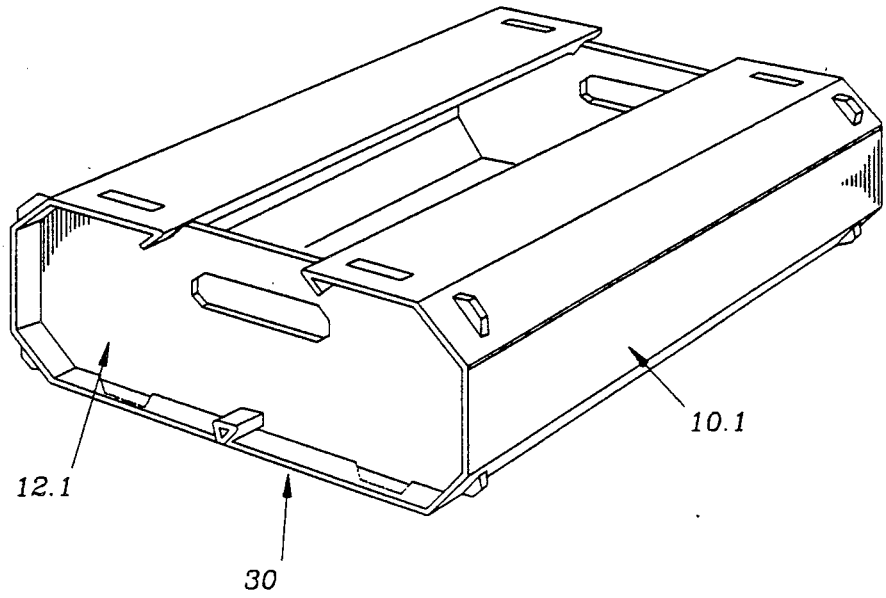
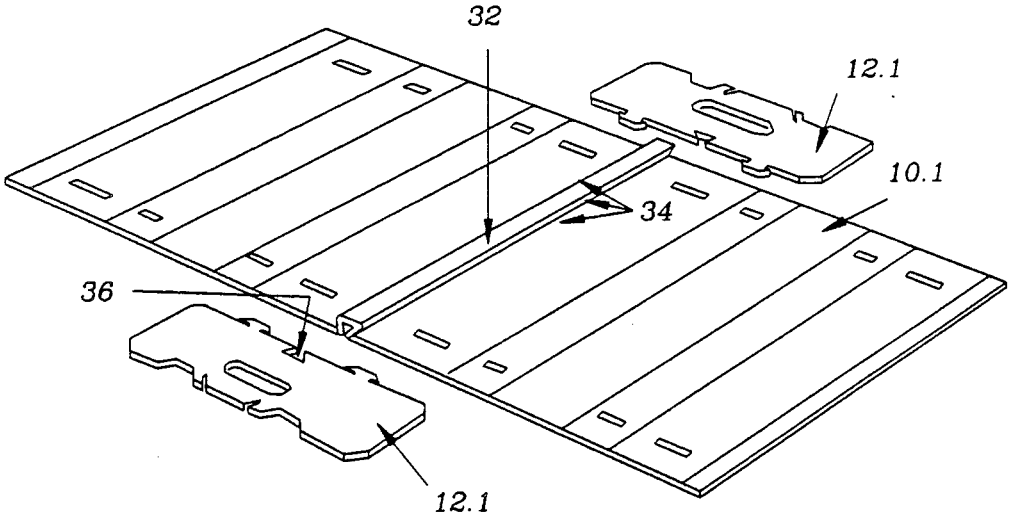
Fig. 4

Fig. 7
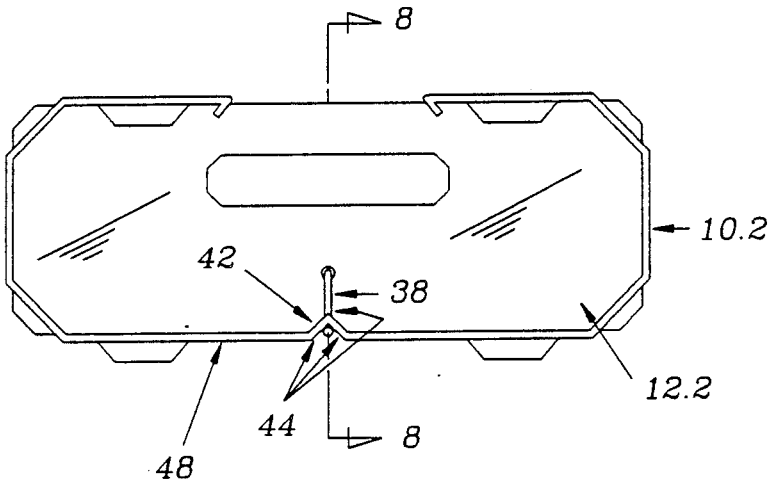
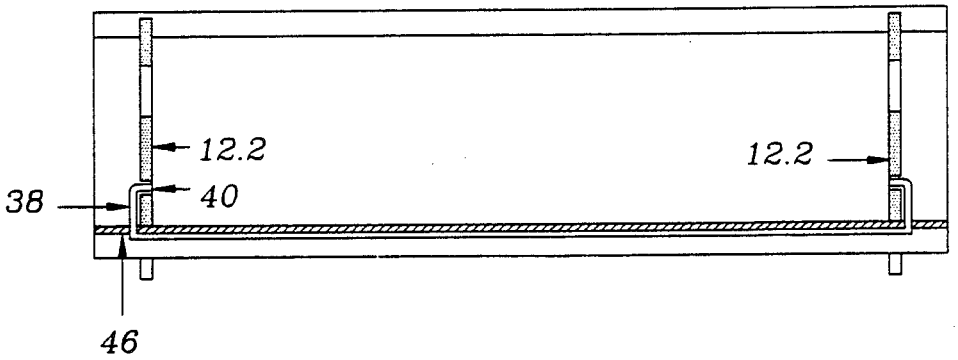
Fig. 8

PACKAGING CONTAINER

BACKGROUND TO THE INVENTION

This invention relates to a packaging container.

The container finds particular application as a packaging and merchandising container for deciduous fruit, vegetables and like and will be described with reference to such an application by way of example.

SUMMARY OF THE INVENTION

The container of this invention comprises at least one web plate and a cover sheet which is wrapped about the periphery of the web plate such that the cover sheet defines a substantially tubular enclosure with the web plate defining a web extending substantially transversely to the principal axis of the tube, the web plate being formed with peripheral clip formations into which the longitudinally extending edges of the cover sheet are clipped to secure the cover sheet to the web plate the clip formations being constituted by slots formed in the periphery of the web plate into which the longitudinally extending edges of the cover sheet are a press fit.

The web plate may be provided with projections extending outwardly from the edges thereof and the cover sheet may be formed with slots complemental to the projections and positioned to allow the projections to extend through the cover sheet slots when the cover sheet is wrapped about the web plate, the clip formations being constituted by slots formed in the projections and the slots being constituted by undercuts in the projections in which the thickness of the cover sheet material is a press fit.

The container may be adapted for stacking by the provision of a web plate adjacent each end of the cover sheet, the end web plates of the container being relatively rigid and the cover sheet slots being positioned to retain the end webs substantially vertically during stacking, the peripheral projections of the web plates and the cover sheet slots being dimensioned and positioned for the complemental interengagement of at least two containers stacked one above the other, the peripheral projections of the web plates and the cover sheet slots being dimensioned and positioned for the complemental interengagement of one or more of the peripheral projections on the web plates of one container each with a corresponding cover sheet slot of an adjacent container, the web plates in the vicinity of the cover sheet slots being formed with recesses complemental to the projection which the slot is to receive.

The stackable container described above may be reinforced by the inclusion of a folded rib in the cover sheet extending between the end web plates, a complemental clip formation being formed in the base edge of each end web plate within which the rib is a longitudinal slide fit.

Alternatively, a complemental notch may be formed in the base edge of each web plate and the container may include a wire clip which is adapted for securement to each end web plate and to extend along and support the rib between the end web plates.

The end plates could be at least partly secured, by means of adhesive, to the cover sheet, which, to this end, may be provided with adhesive tabs on the transversely extending base edges, the tabs including an adhesive zone and a fold line along which the tabs are folded to allow the end web plates adhered thereto to extend substantially normal to the base plain of the cover sheet, the base edges of the web plates being free of peripheral projections.

The invention includes a container preform comprising at least one web plate and a cover sheet blank which is adapted for wrapping about the periphery of the web plate such that the cover sheet defines a substantially tubular enclosure with the web plate defining a web extending substantially transversely to the principal axis of the tube, the web plate being formed with peripheral clip formations into which the longitudinally extending edges of the cover sheet may be clipped to secure the cover sheet to the web plate and the clip formations being constituted by slots formed in the periphery of the web plate into which the longitudinally extending edges of the cover sheet are a press fit.

The web plate may be provided with projections extending outwardly from the edges thereof and the cover sheet will then be formed with slots complemental to the projections and positioned to allow the projections to extend through the cover sheet slots when the cover sheet is wrapped about the web plate, the clip formations being constituted by slots formed in the projections and the slots being constituted by undercuts in the projections in which the thickness of the cover sheet material is a press fit.

For a container which is adapted for stacking, the preform will include a web plate adapted for location adjacent each end of the cover sheet, the end web plates of the container being relatively rigid and the cover sheet slots being positioned to retain the end webs substantially vertically within the container, the peripheral projections of the web plates and the cover sheet slots being dimensioned and positioned for the complemental interengagement of at least two containers stacked one above the other, the peripheral projections of the web plates and the cover sheet slots being dimensioned and positioned for the complemental interengagement of one or more of the peripheral projections on the web plates of one container each with a corresponding cover sheet slot of an adjacent container, the web plates in the vicinity of the cover sheet slots being formed with recesses complemental to the projection which the slot is to receive.

The preform may include fold lines for the folding of a base rib constituted by a folded rib in the cover sheet which is adapted, in the completed container, to extend between the end web plates, a complemental clip formation being formed in the base edge of each end web plate within which the rib is a longitudinal slide fit.

Alternatively, the preform may include fold lines for the folding of a base rib constituted by a folded rib in the cover sheet which is adapted, in the completed container, to extend between the end web plates, a complemental notch being formed in the base edge of each web plate and the container including a wire clip which is adapted for securement to each end web plate and to extend along and support the rib between the end web plates.

The end web plates may conveniently be at least partly secured, by means of adhesive, to the cover sheet, which may be provided with adhesive tabs on the transversely extending base edges, the tabs including an adhesive zone and a fold line along which the tabs may be folded to allow the end web plates adhered thereto to extend substantially normal to the base plane of the cover sheet, the base edges of the web plates being free of peripheral projections.

BRIEF DESCRIPTION OF THE DRAWINGS

In the drawings:

FIG. 1 is an isometric view of a container according to the invention;

FIG. 2 is an isometric view of the container of FIG. 1 in a folded-out-state;

FIG. 3 is an isometric view of a further embodiment of the container of the invention;

FIG. 4 is an isometric view of the container of FIG. 3 in a folded-out-state;

FIG. 7 is an end view of yet a further embodiment of the invention; and

FIG. 8 is a sectional side elevation on a line 8—8 in FIG. 7.

DESCRIPTION OF AN EMBODIMENT OF THE INVENTION

Figure 5:
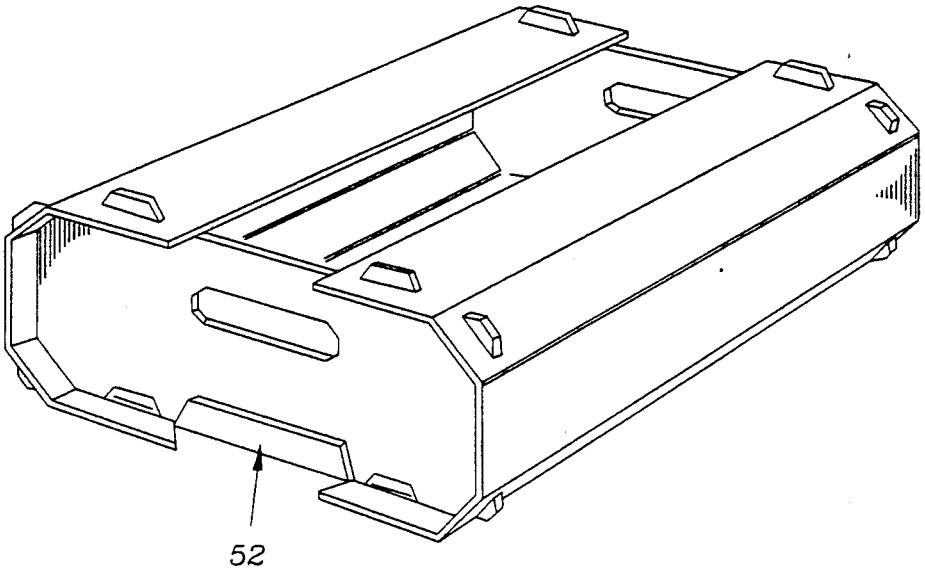
FIG. 5 is an isometric view of yet a further embodiment of the invention.

The container of the invention, in relatively simple form, is illustrated in FIGS. 1 and 2 where the container can be seen to comprise a cover sheet 10 which is wrapped about the peripheries of a pair of end web plates 12. The web plates 12 are a relatively hard material. Examples of such a material are wood particle board (such as that supplied as HARDBOARD (TM) by Masonite Africa Limited) or chipboard, an injection moulded plastics or stiffened or reinforced cardboard. In each case the material of the web plates 12 will be selected and reinforced for more or less rigidity in the plane of the web plate 12 to comply with the desired stacking requirements in respect of the containers.

In FIG. 2 it can be seen how the cover sheet is adapted for wrapping about the periphery of the web plates by means of fold lines 14 which extend parallel to the principal axis of the container, each fold line being adapted for the formation of a crease or fold 16 in the eventual container.

The cover sheet 10 is formed with a plurality of slots 18 through which the material of the end plate is adapted to project. A set of corner slots 18.1 allow the corners 20 of the end plates 12 to project through the cover sheet material thereby securing the end plates 12 in position in the eventual container. A pair of feet slots 18.2 on each end of the container allow feet 22 formed in the end plates 12 to project through the material of the cover sheet. A set of stacking slots 18.3 allow the feet 22 on the end plates 12 of one container to project through the cover sheet material of a container therebelow into stacking recesses 24 formed in the end plates 12.

The end plates 12 are formed with clip formations constituted by slots 26 which are adapted to receive the folded-in edges 28 of the cover sheet whereby the cover sheet may be secured against removal from the web plates.

Proceeding from the folded out state shown in FIG. 2, the web plates 12 are secured with the feet 22 in the slots 18.2 in the cover sheet. The cover sheet is then folded along the fold lines to wrap around the peripheries of the web plates 12 with the corners 20 of the web plates extending through the slots 18.1. Finally the edges 28 of the cover sheet are folded in and secured within the slots 26 and the container is ready for use. The transversely extending edges of the cover sheet may be reinforced. A simple method of reinforcing is to fold the transversely extending edges over and to form the slots through both layers of sheet material. If additional reinforcing is required, the folded over edges may be glued or reinforced with additional reinforcing material.

The containers can now be stacked on top of one another with the feet 22 of another container extending through the stacking slots 18.3 of a lower container for the feet 22 to engage the stacking recesses 24 in the web plates, thereby transferring the mass of an upper container, to the web plates of the lower container. It will be appreciated that, for certain applications, such as in containers adapted for belt conveyance, it is desirable to have the bases of the containers plane. For these applications the web plate configuration of the container will, in essence, be reversed with the "feet" now projecting upwardly into base recesses formed in the containers thereabove.

The container illustrated in FIGS. 3 and 4 differs from that illustrated in FIGS. 1 and 2 by the provision of an additional base clip formation. In order to ensure that the base 30 of the container does not sag unduly under the mass of the contents of the container, a rib 32 may be folded into the base of the container (by the provision of appropriate fold lines 24). A complemental clip formation 36 is formed in the edge of the end plate 12.1. By securing the rib 32 within the clip formation 36, the base 30 is reinforced and retained against sagging.

An alternative base support is shown in FIGS. 7 and 8 where a wire clip 38 is used to retain the base against sagging.

In this embodiment, the end plates 12.2 are formed with clip retaining holes 40 and a base notch 42. The cover sheet is provided with fold lines 44 which enable it to follow the contours of the base notch 42 in the end plates 12.2. The material of the cover sheet 10.2 is also formed with slots of holes 46 through which the wire clip 38 may pass. In use, the wire clip 38 reinforces and supports the base 48 of the container illustrated in FIGS. 7 and 8.

Figure 6:
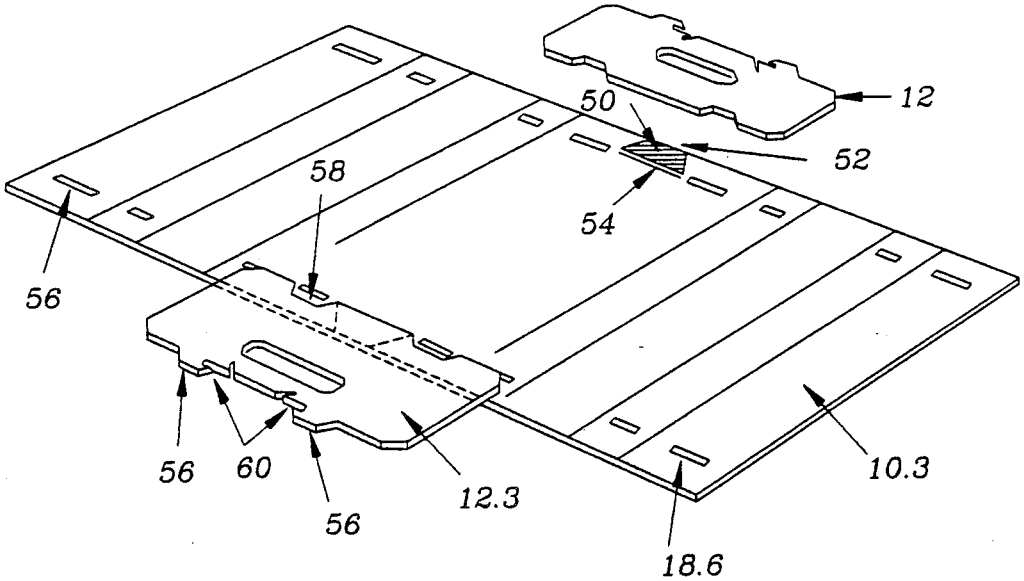
FIG. 6 is an isometric view of the container of FIG. 5 in a folded-out-state.
Figure 9:
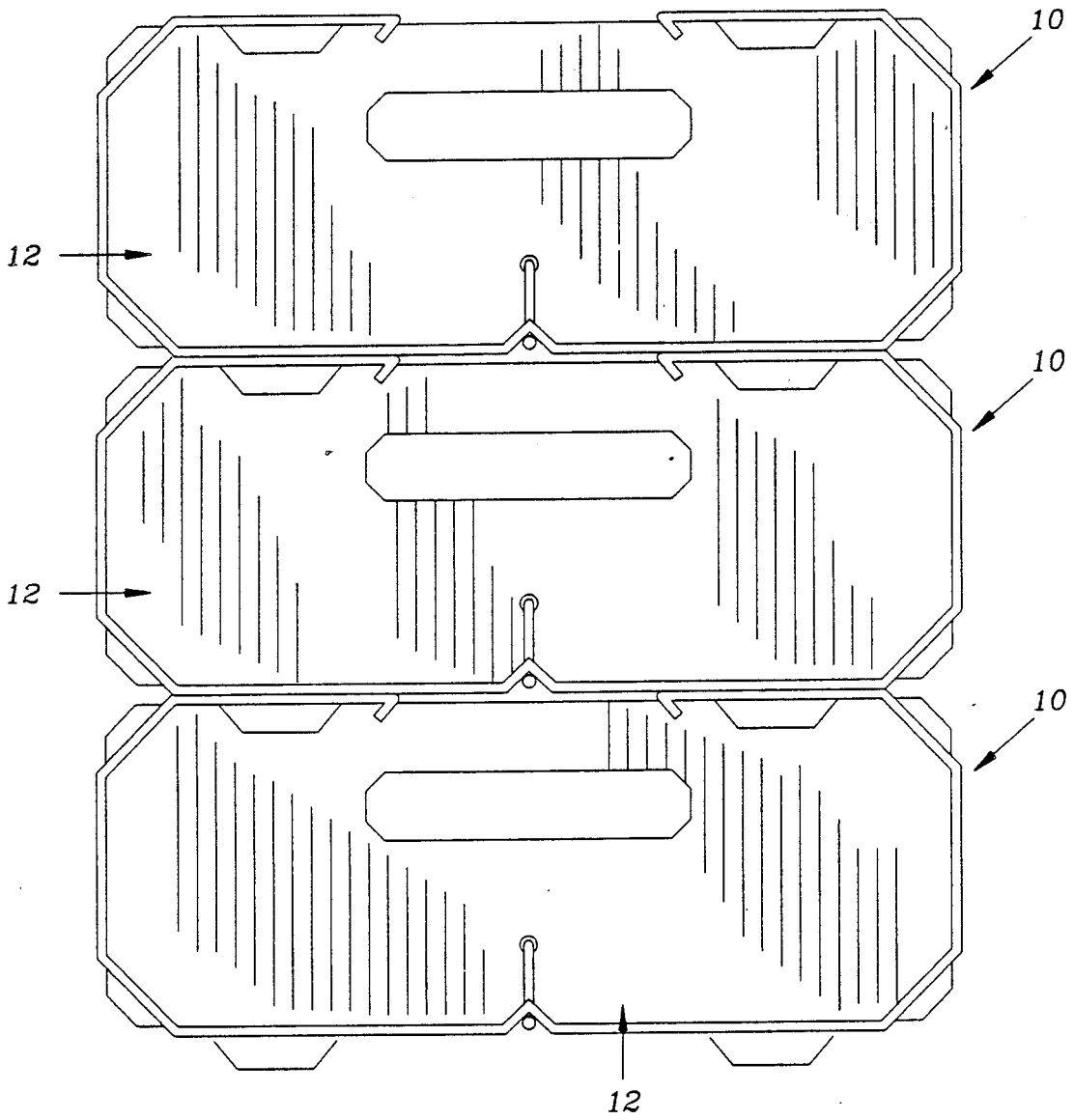
FIG. 9 is an end view of stacked containers.

The containers illustrated thus far have discrete web plates, but the container illustrated in FIGS. 5 and 6 may be supplied to a packer with the end plates 12.3 already secured, by means of adhesive 50 to the cover sheets 10.3. In this embodiment, a tab 52 is formed in the cover sheet, by slitting on either side of the tab 52. An adhesive 50 is applied to the tab and the end plate, if necessary. The end plate 12.3 is then pre-adhered to the tab 52 which has a fold line 54 so that the entire tab 52 with the end plate 12.3 attached thereto can be folded upwardly as shown in FIG. 5.

To facilitate this folding operation, the stacking slots and feet described with reference to FIGS. 1 and 2 are reversed, the end plates 12.3 being provided with stacking shoulders constituted by peripheral projections 56 on the end plates 12.3. The stacking shoulders 56 are adapted for interengagement with base recesses 58 formed in the end plates 12.3, the cover sheet 10.3 in the vicinity of the base recesses 58 being slotted at 18.4, to allow penetration by the stacking shoulders 56 and at 18.6, to allow penetration by the stacking shoulders 56.

The stacking shoulders 56 obviate the need for folded in edges 28 as described with reference to FIGS. 1 and 2, since the stacking shoulders 56 may be used to secure the edges of the cover sheet 10.3 against the web plates 12.3. This is achieved by retaining slots 60 in the stacking shoulders 56. During assembly of the container, the slots 18.6 are now merely clipped into the edge retaining slots 60 on the stacking shoulders 56. The projecting parts of the web plates 12 may be slotted, similarly to the edge retaining slots 60.

I claim:

1. A container comprising a multiplicity of web plates and a cover sheet extending about the peripheries of said web plates to define a substantially tubular enclosure with said web plates extending substantially transversely to a principal axis of said tube, said cover sheet including a base panel, and arranged in opposed spaced relationship, upright side panels, top closure panels and joinder panels interconnecting said bare panel and said side panels, which said joinder panels are angularly disposed relatively to said side panels and formed with transversely extending slots within which said web plates constitute a friction fit, said peripheral corners of said web plates being dimensioned to extend through said slots frictionally to secure said cover sheet to said web plates and to retain said webs substantially transversely to said principal axis of said tube, said container being capable of arrangement in a vertical stacked relationship with a second container of like configuration in that said web plates are relatively rigid, locking projections being formed in each said web plate which extend outwardly from one of said vertically disposed edges thereof, said cover sheet is conformed with said slots which are complementary to said locking projections and positioned to allow said locking projections to extend through said cover sheet slots when said cover sheet is formed about said web plates, said locking projections of said web plates and said cover sheet slots being dimensioned and positioned for complementary interengagement of one or more of said locking projections on said web plates of one container with a corresponding cover sheet slot of an adjacent container, and said web plates in the vicinity of said cover sheet slots being formed with recesses complementary to the said locking projection which said slot is to receive.

2. A container comprising a multiplicity of web plates and a cover sheet extending about peripheries of said web plates to define a substantially tubular enclosure with said web plates extending substantially transversely to a principal axis of said tube, said cover sheet including a base panel, and arranged in opposed spaced relationship, upright side panels, top closure panels and pairs of joinder panels located on both sides of said side panels connecting said side panels to said base panel and said top closure panels respectively, which each of said pair of joinder panels are angularly disposed relatively to said side panels and formed with transversely extending slots within which said web plates constitute a friction fit, said peripheral corners of said web plates being dimensioned to extend through said slots frictionally to secure said cover sheet to said web plates and to retain said webs substantially transversely to said principal axis to said tube, said container being capable of arrangement in a vertical stacked relationship with a second container of like configuration in that said web plates are relatively rigid, locking projections being formed in each web plate extending outwardly from one of said vertically disposed edges thereof, said cover sheet conformed with said slots which are complementary to said locking projections to extend through said cover sheet slots when said cover sheet is formed about said web plates, said locking projections of said web plates and said cover sheet slots being dimensioned and positioned for complementary interengagement of one or more of said locking projections on said web plates of one container with a corresponding cover sheet slot of an adjacent container, and said web plates in the vicinity of said cover sheet slots being formed with recesses complementary to said locking projections said slots to receive.

3. A container according to claims 1 or 2 further comprising a base rib formed by a folded rib in said cover sheet extending between said web plates, a complementary clip formation being formed in said base edge of each said web plate into which said rib is a longitudinal slide fit.

4. A container according to claims 1 or 2 further comprising a base rib formed by a folded rib in the cover sheet extending between said web plates, a complementary notch being formed in said base edge of each said web plate and said container including a wire clip which is adopted for securing to each said web plate and extending along and supporting said rib between said web plates.

5. A container according to claims 1 or 2 further comprising an adhesive means in which said web plates are partly secured by said adhesive means to said cover sheet which is provided with adhesive tabs on said transversely extending base edges, said tabs including adhesive zones and a fold line along which said tabs are folded allowing said web plates to be adhered thereto and extending substantially normal to said base plate of said cover sheet, said base edges of said web plates being free of peripheral projections.

6. A container preform for a container comprising a multiplicity of web plates to be wrapped with a cover sheet extending about a periphery of said web plates to define a substantially tubular enclosure with said web plates extending substantially transversely to a principal axis of said tube, where said cover sheet is part of a preform and said preform being an assembly of said cover sheet including a base panel, and arranged in opposed spaced relationship, upright side panels, top closure panels and pairs of joinder panels located on both sides of said side panels connecting said side panels to said base panel and said top closure panels respectively, which each of said pair of joinder panels are angularly disposed relatively to said side panels and formed with transversely extending slots within which said web plates constitute a friction fit, said peripheral corners of said web plates being dimensioned to extend through said slots frictionally to secure said cover sheet to said web plates and to retain said webs substantially transversely to said principal axis to said tube, said web plates being relatively rigid and, locking projections being formed in each of said web plate which extend outwardly from one of said edges thereof, said cover sheet conformed with said slots which are complementary to said locking projections to extend through said cover sheet slots when said cover sheet is formed about said web plates, said locking projections of said web plates and said cover sheet slots being dimensioned and positioned for complementary interengagement of one or more of said locking projections on said web plates of one container with a corresponding cover sheet slot of an adjacent container, and said web plates in the vicinity of said cover sheet slots being formed with recesses complementary to said locking projections said slots to receive.

7. A container preform according to claim 6 further comprising a base rib formed by a folded rib in the cover sheet extending between said web plates, a complementary notch being formed in said base edge of each said web plate and said container including a wire clip which is adopted for securing to each said web plate and extending along and supporting said rib between said web plates.

8. A container according to claim 6 further comprising an adhesive means in which said web plates are partly secured by said adhesive means to said cover sheet which is provided with adhesive tabs on said transversely extending base edges, said tabs including adhesive zones and a fold line along which said tabs are folded allowing said web plates to be adhered thereto and extending substantially normal to said base plate of said cover sheet, said base edges of said web plates being free of peripheral projections.

* * * * *